US009241546B2

(12) United States Patent
Hortnagl

(10) Patent No.: US 9,241,546 B2
(45) Date of Patent: Jan. 26, 2016

(54) BUCKLE

(71) Applicant: ABA Hortnagl GmbH, Fulpmes (AT)

(72) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 0 days.

(21) Appl. No.: 14/360,997

(22) PCT Filed: Nov. 27, 2012

(86) PCT No.: PCT/AT2012/000298
§ 371 (c)(1),
(2) Date: May 28, 2014

(87) PCT Pub. No.: WO2013/078486
PCT Pub. Date: Jun. 6, 2013

(65) Prior Publication Data

US 2014/0325804 A1 Nov. 6, 2014

(30) Foreign Application Priority Data

Dec. 2, 2011 (AT) ..... A 1786/2011

(51) Int. Cl.
*A44B 11/28* (2006.01)
*A44B 11/26* (2006.01)

(52) U.S. Cl.
CPC ..... *A44B 11/28* (2013.01); *A44B 11/263* (2013.01); *Y10T 24/4523* (2015.01)

(58) Field of Classification Search
CPC ..... A44B 11/263; A44B 11/25; A44B 11/26; A44B 11/28; Y10T 24/4523
USPC ..... 24/323, 592.1, 600.9
See application file for complete search history.

(56) References Cited

U.S. PATENT DOCUMENTS

| | | | | |
|---|---|---|---|---|
| 1,821,839 | A | | 9/1931 | Kerngood |
| B532,476 | I5 | | 2/1976 | Stafstrom |
| 3,992,756 | A | * | 11/1976 | Stafstrom ..... 24/323 |
| 4,074,401 | A | | 2/1978 | Spinosa et al. |
| 4,158,907 | A | * | 6/1979 | Spinosa et al. ..... 24/600.9 |
| 4,408,373 | A | | 10/1983 | Miskowicz |
| 5,170,539 | A | | 12/1992 | Lundstedt et al. |

(Continued)

FOREIGN PATENT DOCUMENTS

| | | |
|---|---|---|
| AT | 413786 | 6/2006 |
| AT | 506214 | 7/2009 |

(Continued)

OTHER PUBLICATIONS

Pages 1-7 from www.charly-produkte.de—PL-Hook Gurtschloss, dated Nov. 24, 2011.

*Primary Examiner* — Robert J Sandy
*Assistant Examiner* — David Upchurch
(74) *Attorney, Agent, or Firm* — Volpe and Koenig, P.C.

(57) ABSTRACT

A buckle, in particular a belt buckle, having at least one hook part (2) and at least one eye part (3), wherein the hook part (2) includes a hook part base body (4) and a hook (5) fixedly connected thereto, and in a connected state of the buckle (1), the eye part (3) is hooked into the hook (5) of the hook part (2), and in a separated state of the buckle (1), the eye part (3) is unhooked from the hook (5) of the hook part (2), wherein the buckle (1) has a securing device for securing the connected state, and the securing device has at least one spring tongue (6).

19 Claims, 5 Drawing Sheets

(56) References Cited

U.S. PATENT DOCUMENTS

| | | | |
|---|---|---|---|
| 5,471,714 | A | 12/1995 | Olson |
| 5,561,891 | A | 10/1996 | Hsieh |
| 5,604,964 | A | 2/1997 | Aoshima |
| 5,651,166 | A | 7/1997 | Lundstedt |
| 5,784,767 | A | 7/1998 | Doty, Jr. |
| 5,893,199 | A | 4/1999 | Anscher |
| 6,023,820 | A | 2/2000 | Fair |
| 6,463,640 | B1 | 10/2002 | Toth |
| 8,561,268 | B2 | 10/2013 | Hortnagl |
| 2003/0197415 | A1 | 10/2003 | Dingman |
| 2004/0078943 | A1 | 4/2004 | Hede et al. |
| 2006/0101627 | A1 | 5/2006 | Ida |
| 2007/0186394 | A1 | 8/2007 | Hsiao |
| 2009/0044383 | A1 | 2/2009 | Gastaldi |
| 2010/0071173 | A1 | 3/2010 | Hortnagl |
| 2014/0082902 | A1 | 3/2014 | Hortnagl |

FOREIGN PATENT DOCUMENTS

| | | |
|---|---|---|
| CH | 674302 | 5/1990 |
| DE | 1557461 | 4/1970 |
| DE | 69315136 | 3/1998 |
| EP | 2191739 | 6/2010 |
| GB | 1066740 | 4/1967 |
| WO | 03059107 | 7/2003 |

* cited by examiner

Fig. 1
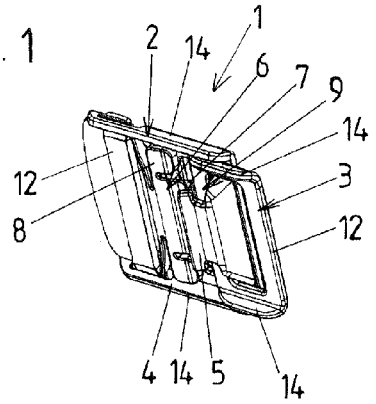
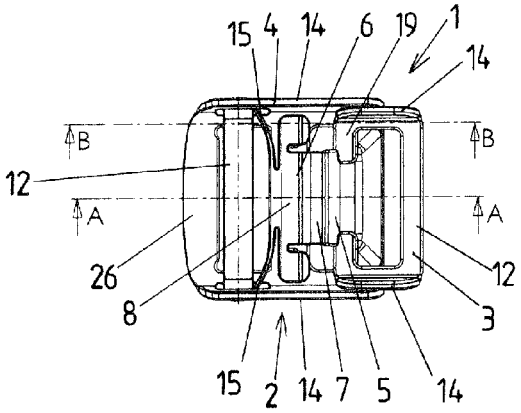
Fig. 2
Fig. 3
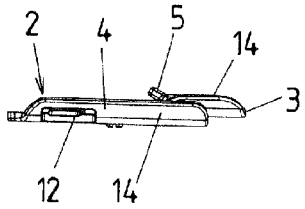
Fig. 4
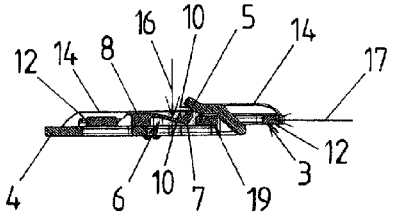
Fig. 5
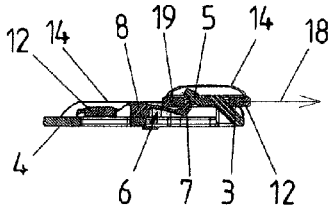
Fig. 6
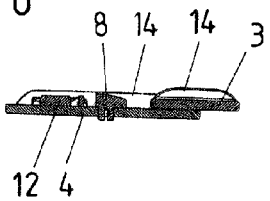

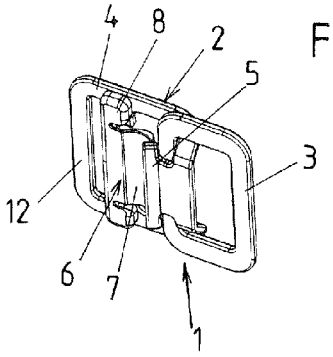
Fig. 13
Fig. 14
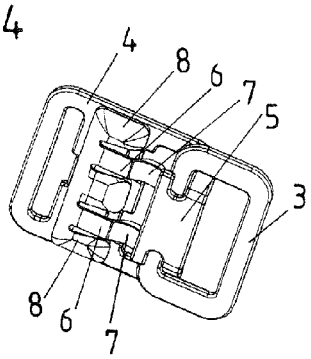
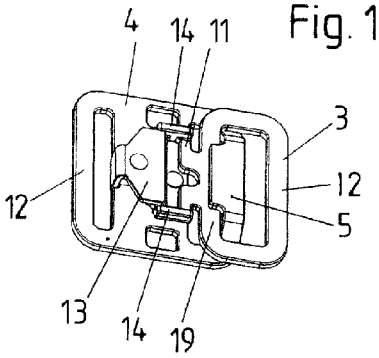
Fig. 15
Fig. 16
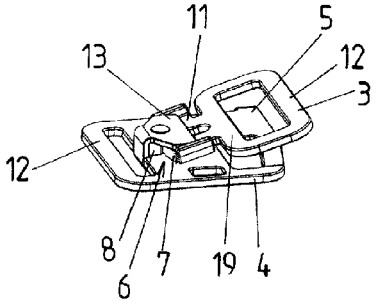
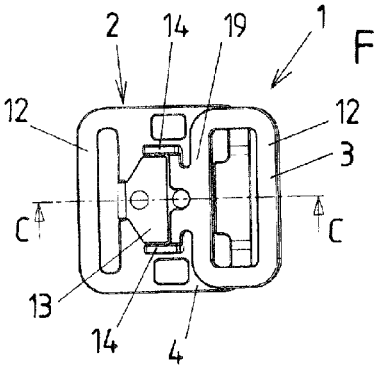
Fig. 17
Fig. 18
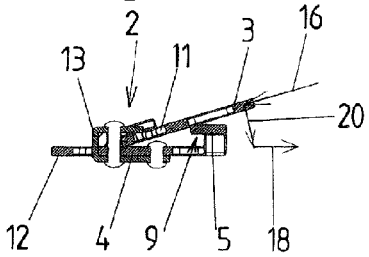
Fig. 19
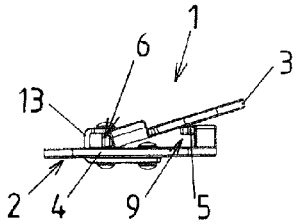

BUCKLE

BACKGROUND

The present invention relates to a buckle, in particular a belt buckle, with at least one hook part and at least one eye part, wherein the hook part has a hook part base body and a hook rigidly connected thereto and, in a connected state of the buckle, the eye part is hooked into the hook of the hook part and, in a separated state of the buckle, is unhooked from the hook of the hook part, wherein the buckle has a securing device for securing the connected state.

Generic buckles and belt buckles are known from the prior art. They are used to connect two or more belts, ropes, straps or the like together or to other bodies. The securing device serves to prevent the eye part from accidentally or unintentionally coming out of the connected state, in other words from being unhooked from the hook of the hook part. Generic buckles are known by virtue of public prior use in which a push button is used as the securing device. This is fastened to the hook part. The eye part can only be unhooked from the hook of the hook part when this push button is pressed.

A disadvantage of this buckle which has become known from public prior use is that, because they are not pressed from exactly above, push buttons generally have the tendency to or wear out or jam. Furthermore, push buttons which are guided in a guide are generally prone to contamination and their functioning can be affected by particles of dirt which penetrate between the guide and push button.

SUMMARY

The object of the invention is to improve a generic buckle such that it is minimally liable to contamination.

This is achieved according to the invention by the securing device having at least one leaf spring.

A high degree of operational reliability and a marked reduction in the tendency to become contaminated are achieved by the leaf spring of the securing device. The leaf spring can preferably be elastically deflected out of a blocking position into a release position. In the blocking position, it prevents the eye part from becoming unhooked from the hook of the hook part and thus secures the buckle in its connected state. In the release position, the eye part can be unhooked from the hook of the hook part and the buckle can thus be brought into its separated state. The leaf spring preferably springs back elastically into the blocking position when it is let go in the release position, as a result of which the securing of the connected state of the buckle, effected by the securing device, is achieved when the eye part is correspondingly hooked into the hook.

The leaf spring is advantageously a strip- or blade-like body which has an inherently elastically resilient design and/or is suspended in an elastically resilient fashion. In the latter alternative embodiment, the leaf spring itself can also be designed at least in places as an inherently rigid body. The eye part is a body which has at least one opening or eye via which it can be hooked into the hook.

Preferred embodiments of the invention provide that the leaf spring has a freely projecting tongue section and a fastening section for fastening the leaf spring to the hook part, preferably to the hook part base body. The leaf spring is advantageously as far as possible made independent so that its functioning cannot be hindered by dirt accumulating between it and adjoining components. To this end, preferred embodiments of the invention provide that the leaf spring is fastened exclusively with the fastening section on the hook part, preferably on the hook part base body. It is furthermore advantageous if the freely projecting tongue section is in contact with the hook part exclusively via the fastening section. In embodiments in which the tongue section contacts the hook directly in the blocking position of the leaf spring, it can alternatively be provided that the freely projecting tongue section is in contact with the hook part exclusively via the fastening section and the hook.

As mentioned, the leaf spring can be inherently elastic or be suspended inherently rigidly and resiliently at least in places. An elastic movement should in any case be possible between the tongue section and the fastening section. The leaf spring can preferably be manufactured from metal and/or plastic. It may be a pure metal body or a pure plastic body, but also a body with different materials such as, for example, metal and plastic. The hook part and eye part can also be manufactured from metal and/or plastic, to mention suitable materials by way of example. Steel or especially aluminum are appropriate metals, as required. The different components of the buckle, in particular the hook part and the eye part, can, for example, take the form of bent sheet metal parts or castings.

A preferred group of alternative embodiments of the invention provide that the leaf spring, preferably a freely projecting tongue section of the leaf spring, has a blocking position in which the leaf spring, preferably the tongue section, fully or partially blocks a receiving opening of the hook for receiving the eye part, and that the leaf spring, preferably the tongue section, has a release position in which the leaf spring, preferably the tongue section, releases the receiving opening of the hook for introducing and/or withdrawing the eye part into and/or out of the receiving opening. In the blocking position, the leaf spring can preferably thus even bear directly against the hook with its freely projecting tongue section. It is favorable if the eye part can be hooked into the hook part or its hook without there being any need to actuate the leaf spring individually to do this. This can, for example, be achieved by the leaf spring, preferably the freely projecting tongue section, and/or the hook having at least one guide surface against which the eye part can be applied in the blocking position, wherein the leaf spring, preferably the freely projecting tongue section, can be pivoted into the release position by pulling the eye part bearing against the guide surface toward the receiving opening. It is of course possible to press in the corresponding direction instead of pulling. It can be provided that the leaf spring, preferably the freely projecting tongue section, can be pivoted from the blocking position into the release position toward the hook part base body.

Another group of embodiments according to the invention provides that the eye part has an eye part section, preferably formed in the form of a protruding projection, which, in order to hook the eye part into the hook, can be pushed into a cross-sectionally U-shaped groove of the hook part when the leaf spring, preferably a freely projecting tongue section of the leaf spring, is deflected. The leaf spring can here be arranged in the cross-sectionally U-shaped groove of the hook part. Furthermore, the leaf spring can be arranged on the hook part, opposite the hook part, at a distance from it.

The hook part base body and/or the eye part preferably have a fastening means for fastening a belt. These components can, however, also have a fastening means for fastening a rope, or other suitable connection means via which they can be fastened to other bodies. The hook part base body and/or the hook and/or the eye part are preferably designed as inherently rigid bodies. A body is inherently rigid if it does not undergo any deformation when it is subjected to forces. The hook and also the said U-shaped groove can be integrally formed with the hook part base body. However, these components can also be manufactured separately initially and then fastened to the hook part base body. Alternative fastening methods that may be encountered are, for example, welding, bonding, riveting, screwing or other fastening measures known per se.

Particularly preferred embodiments of the invention provide that the buckle has a displaceably mounted bar as the fastening means for a belt or a rope or a strap, wherein the bar is pre-tensioned toward a clamping position by means of at least one pre-tensioning spring and the pre-tensioning spring is part of the leaf spring. In these alternative embodiments, the belt, the rope or the strap can be passed around the displaceably mounted bar serving as the fastening means and clamped between this bar and the counter-bar arranged fixedly on the hook part base body. The loading of the displaceably mounted bar by means of a pre-tensioning spring prevents the belt, rope or strap from inadvertently being loosened when it is not under tension. A highly compact construction with as few buckle parts as possible is achieved as a result of integrating the at least one pre-tensioning spring into the leaf spring.

In order to allow the eye part to be hooked into the hook part without any visual contact, i.e. almost blind, preferred embodiments of the invention provide that the hook part and the eye part each have mutually corresponding guide walls. It is hereby favorable if the guide walls are each designed such that they extend obliquely with respect to the other areas of the hook part and the eye part.

BRIEF DESCRIPTION OF THE PREFERRED EMBODIMENTS

Other advantages and features of preferred embodiments of the invention are explained with the aid of exemplary embodiments of the invention which are shown in the drawings, in which:

FIGS. 1 to 9 show a first exemplary embodiment according to the invention;

FIG. 13 shows a fourth exemplary embodiment according to the invention;

FIG. 14 shows a fifth exemplary embodiment according to the invention;

FIGS. 15 to 22 show a sixth exemplary embodiment according to the invention;

DETAILED DESCRIPTION OF THE PREFERRED EMBODIMENTS

Figure 7:
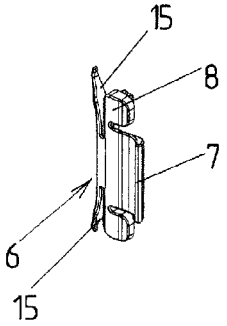
Figure 8:
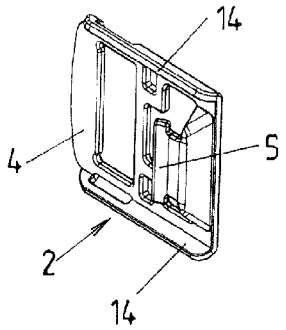
Figure 9:
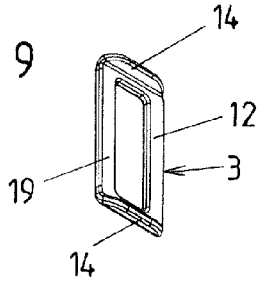

FIG. 1 shows the first exemplary embodiment of a buckle 1 according to the invention in a perspective view, wherein the eye part 3 is clipped into the hook 5 of the hook part 2 via its clip-in bar 19. The connected state of the buckle 1 is thus shown. FIG. 2 shows a plan view of this situation. FIG. 3 shows a side view of this situation. FIG. 4 shows the cross-section along the line of section AA from FIG. 2, in which the buckle 1 is situated in the connected state secured by means of the securing device or the leaf spring 6. FIG. 5 shows an otherwise identical cross-section except that in FIG. 5 the eye part 3 has not yet been fully hooked into the hook 5 of the hook part 2. FIG. 6 shows the cross-section along the line of section BB from FIG. 2. FIG. 7 shows the leaf spring 6 of this first exemplary embodiment, FIG. 8 the hook part 2, and FIG. 9 the eye part 3, in each case detached from the other components.

In the exemplary embodiment shown, the components can be manufactured from metal or plastic, and they can be castings, injection-molded parts or the like. The components can, however, also be produced from bent pieces of sheet metal. The buckle 1 has the hook part 2. In the exemplary embodiment shown, the hook 5 of this hook part 2 is integrally formed on the hook part base body 4 of this hook part 2. The eye part 3 can be hooked into the hook 5. A clip-in bar 19 of the eye part 3 is provided for this purpose. In the connected state shown in FIGS. 1 to 4 and 6, the clip-in bar 19 of the eye part 3 is introduced into the receiving opening 9 of the hook 5 in order to hook it in. The leaf spring 6 secures the eye part 3 in the hooked-in connected state via its tongue section 7, as can be seen particularly clearly in the cross-section according to FIG. 4. The leaf spring 6 and its tongue section 7 are shown in FIG. 4 in the blocking position in which the eye part 3 cannot be unhooked from the receiving opening 9 of the hook. In order to be able to unhook the eye part 3 and its clip-in bar 19, the leaf spring 6 and its tongue section 7, formed so that it freely projects, must be pressed inwards in the direction of pressing 16. As a result, the tongue section 7 pivots toward the hook part base body 4 into its release position in which the eye part 3 can then be unhooked from the hook 5 via its clip-in bar 19 by pushing or pulling in the direction of pushing 17, and the buckle 1 can thus be brought into the separated state. When hooking in, in the exemplary embodiment shown there is no need to press separately and directly by hand on the tongue section 6 to bring the latter into its release position. To do this, in the first exemplary embodiment shown, guide surfaces 10 are formed on both the hook 5 and on the tongue section 7. If the eye part 3 is bearing against the guide surfaces 10, in particular via its clip-in bar 19, as shown in FIG. 5, it is sufficient to pull the eye part 3 toward the receiving opening 9. By pulling in the direction of pulling 18 in this way, the leaf spring 6 and its freely projecting tongue section 7 are then pivoted into the release position by virtue of the eye part 3 sliding along the guide surfaces 10, as a result of which the eye part 3 can then be introduced into the receiving opening 9 of the hook 5 via its clip-in bar 19. Once this has happened, the freely projecting tongue section 17 snaps back elastically into its blocking position, to achieve once more the securing in the connected state according to FIG. 4.

In the first exemplary embodiment shown, the tongue section 7 of the leaf spring 6 is in contact with the hook part 2 only via the fastening section 8 of the leaf spring 6 and the contact with the hook 5 which exists in the blocking position. Otherwise, the freely projecting tongue section 7 is free of any contact with other components of the buckle 1 and in particular of the hook part 2. This free position of the tongue section 7 prevents any dirt that may have been deposited on the tongue section 7 from having a negative effect on the capacity of the securing device and the leaf spring 6 to function.

In the first exemplary embodiment shown, the hook part 2 and the eye part 3 both each have mutually corresponding guide walls 14. In the first exemplary embodiment, these are in each case designed so that they extend obliquely with respect to the other areas of the hook part 2 and the eye part 3 such that they exert a certain centering effect when hooking in and unhooking. Moreover, they also contribute to stabilizing the buckle 1 in the connected state.

In order to be able to fasten a belt or a strap or a rope, both the hook part 2 and the eye part 3 each have a fastening means 12. The eye part 3 is here a bar arranged fixedly on the remaining eye part 3 and positioned opposite the clip-in bar 19. In this exemplary embodiment, the fastening means 12 of the hook part 2 for the belt is a displaceably mounted bar. In the first exemplary embodiment, the latter is pre-tensioned toward a clamping position shown in FIG. 2 by means of the pre-tensioning spring 15. A belt, not shown here, can, as is known per se, be passed around the bar serving as a fastening means 12 and be clamped between this bar and the counter-bar 26 arranged fixedly on the hook part base body. Loading by means of the pre-tensioning spring 15 prevents inadvertent loosening of the belt, not shown here, when the latter is not under tension. As can be seen particularly well in FIG. 7, in this exemplary embodiment it is provided that the pre-tensioning springs 15 are part of the leaf springs 6 according to the invention, as are the fastening section 8 and the freely projecting tongue section 7. However, this does of course not necessarily have to be the case. The pre-tensioning springs 15 could also be designed separately as independent components. There may also be just one or more than two pre-tensioning springs 15.

Figure 10:
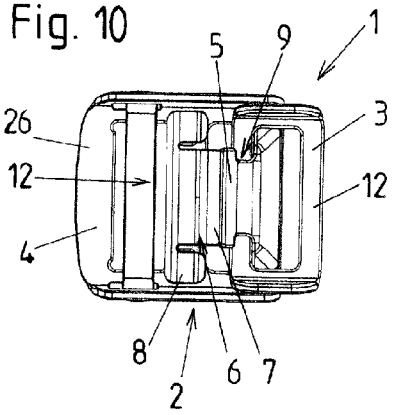
FIG. 10 shows a second exemplary embodiment according to the invention.

FIG. 10 shows a second exemplary embodiment according to the invention of a buckle 1, in which these pre-tensioning springs 15 have been omitted altogether. However, this second exemplary embodiment otherwise has an identical design to the first exemplary embodiment so that any further explanation is superfluous.

Figure 11:
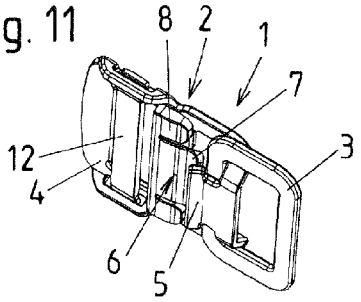
FIGS. 11 and 12 show a third exemplary embodiment according to the invention.
Figure 12:
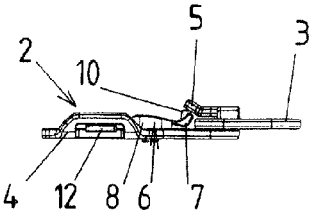

Based on this second exemplary embodiment according to FIG. 10, FIG. 11 shows a further variation of the buckle 1 according to the invention. In this third exemplary embodiment according to FIG. 12, the guide walls 14 have been omitted altogether on the hook part 2 and the eye part 3. FIG. 11 shows a perspective view, FIG. 12 a side view. Because this exemplary embodiment ultimately is likewise the result of the first exemplary embodiment, apart from the modifications mentioned, no further explanation is necessary here either.

FIG. 13 shows a further variation in the form of a fourth exemplary embodiment according to the invention. The guide walls 14 and the pre-tensioning spring 15 are missing here too. In contrast to the above described exemplary embodiments, the fastening means 12 of the hook part 2 in the alternative according to FIG. 13 is a bar arranged fixedly on the hook part base body 4.

FIG. 14 shows, in a fifth embodiment according to the invention, a variation of the alternative according to FIG. 13. There is no longer just one freely projecting tongue section 7 here. In the embodiment according to FIG. 14, the leaf spring 6 has two tongue sections 7, arranged elastically pivotably on a common fastening section 8, which however otherwise function in a similar fashion to that described above.

FIGS. 15 to 22 show a sixth exemplary embodiment according to the invention, in which, however, the arrangement and design of the leaf spring 6 of the securing device differs significantly from the design of the leaf springs 6 in the above described exemplary embodiments.

In the sixth exemplary embodiment, the eye part 3 has an eye part section 11 which, when the eye part 3 is hooked into the hook 5, serves to deflect a leaf spring 6 which is arranged in a cross-sectionally U-shaped groove 13 of the hook part 2. As can be seen particularly well in FIG. 21, the eye part section 11 is designed in the form of a projection protruding from the remaining eye part 3. In the exemplary embodiment shown, this projection has guide walls 14. These guide walls 14 have a guide function when the eye part section 11 is pushed into the cross-sectionally U-shaped groove 13, by sliding against its outer edges. The cross-sectionally U-shaped form of the groove 13 can best be seen in the cross-section according to FIG. 18 along the line of section CC shown in FIG. 17 and in the side view according to FIG. 19. The cross-sectionally U-shaped groove 13 can be designed as a separate component and, as here, be fastened to the hook part base body 4 by means of rivets. Of course other forms of fastening such as welding, screwing and the like are also possible. The U-shaped groove 13 can also be arranged integrally on the hook part base body 4. The leaf spring 6 with its freely projecting tongue sections 7 is largely covered below the walls forming the groove 13. It can best be seen in FIG. 16 and in the exploded view according to FIG. 22. The leaf spring 6 of this exemplary embodiment has two tongue sections 7, arranged on opposite sides of the fastening section 8, which both project freely. The fastening section 8 is mounted in a leaf spring bearing 21 which is arranged, together with the leaf spring 6, in the cross-sectionally U-shaped groove 13.

Figure 20:
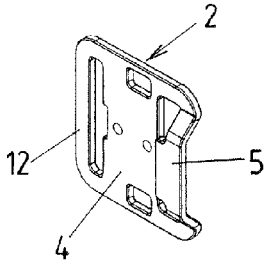
Figure 21:
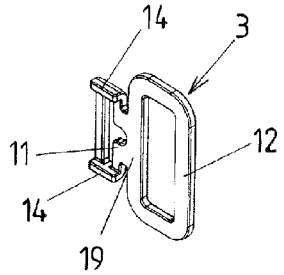
Figure 22:
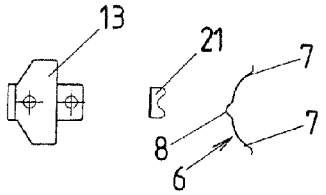
Figure 23:
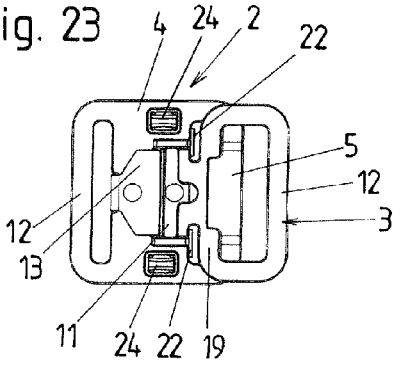
FIGS. 23 to 26 show a seventh exemplary embodiment according to the invention.
Figure 24:
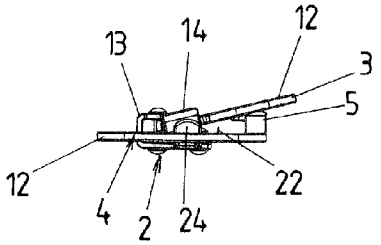
Figure 25:
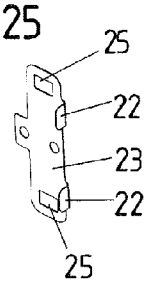
Figure 26:
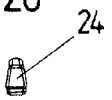

The hook part 2 of this exemplary embodiment is shown in FIG. 20. The integral formation of the hook part base body 4, the hook 5 and the fastening means 12 for the belt of this exemplary embodiment can be seen well in FIG. 20. In order to hook the eye part 3 into the hook 5 of this exemplary embodiment, the eye part section 11 is pushed in the direction of pressing 16 initially into the groove 13, and to be so precise so far that it deflects the tongue sections 7 and the receiving opening of the eye part 3 is aligned with the hook 5. When this position is reached, the eye part 3 is pivoted in the direction of pivoting 20 toward the hook part base body 4. The freely projecting tongue sections 7 of the leaf spring 6 then push the eye part 3 with its clip-in bar 19 in the direction of pulling 18 and thus into the receiving opening 9 of the hook 5, as a result of which the eye part 3 is hooked into the hook 5 of the hook part 2.

In the connected state of the buckle 1, as shown in FIG. 15, the leaf spring 6 presses the eye part 3 toward the hook 5 with its freely projecting tongue sections 7 and thus assumes the desired securing function against undesired unhooking. When it is desired to remove the eye part 3 from the hook 5, the opening process takes place in reverse to the above described hooking-in process.

The seventh exemplary embodiment according to the invention according to FIGS. 23 to 26 builds on the sixth exemplary embodiment according to the invention of FIGS. 15 to 22. The only difference is that in the seventh exemplary embodiment according to the invention additional securing of the connected state by means of the blocking spring 23 is incorporated. FIG. 15 shows this blocking spring 23 with its blocking tabs 22 and the actuating element sockets 25. In the connected state, as shown in plan view in FIG. 23, the blocking tabs 22 project through an opening in the hook part base body 2. In this position they prevent the clip-in bar 19 of the eye part 3 from being able to be pushed so far toward the cross-sectionally U-shaped groove 13 that the eye part 3 may become unhooked from the hook 5. Apart from the blocking tabs 22, the blocking spring 23 is fastened to the hook part base body 4 on an underside of the latter which faces away from the hook 5. An actuating element 24 is in each case situated in each fastening element socket 25, as shown separately in FIG. 26. The actuating elements 24 penetrate through corresponding openings in the hook part base body 4 such that from the front side, visible in FIG. 23, of the buckle 1 it is possible to actuate, in other words press in, the actuating elements 24 by hand. If these actuating elements 24 are pressed downward, i.e. toward that side of the hook part base body 4 which faces away from the hook 5, the blocking tabs 22 are consequently also pulled downward so that the eye part 3 can then be unhooked with the leaf spring 6 compressed.

The blocking spring 23 thus forms a further securing device provided in addition to the leaf spring 6.

The fundamental structure of the eighth exemplary embodiment according to FIGS. 27 to 35 is similar to the first exemplary embodiment according to FIGS. 1 to 9. Unless explained below, the same design features apply for this eighth exemplary embodiment of the invention as for the first exemplary embodiment of the invention. In particular, in the eighth exemplary embodiment according to FIGS. 27 to 35 it is also provided that the buckle 1 has a displaceably mounted bar as the fastening means 12 for a belt or a rope or a strap, wherein the bar is pre-tensioned toward a clamping position by means of at least one pre-tensioning spring 15 and the pre-tensioning spring 15 is part of the leaf spring 6. As also in the first exemplary embodiment, this fastening means 12 is a bar mounted, preferably displaceably, on the hook part base body 4.

In the eighth exemplary embodiment, both the hook part 2 and the eye part 3, as also in the first exemplary embodiment, each have mutually corresponding guide walls 14. These are designed so that they extend obliquely with respect to the other areas of the hook part 2 and the eye part 3. They thus perform a guide function when the eye part 3 is hooked into and unhooked from the hook part 2.

Figure 27:
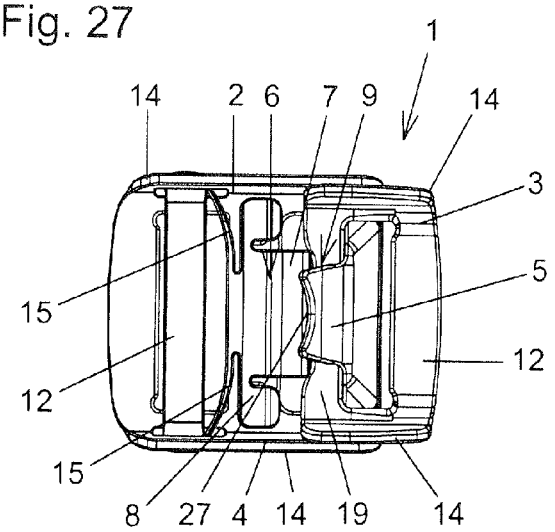
FIGS. 27 to 35 show an eighth exemplary embodiment according to the invention.
Figure 28:
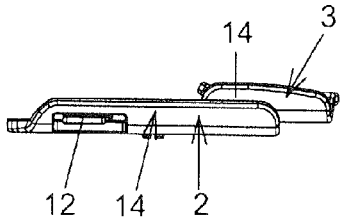
Figure 30:
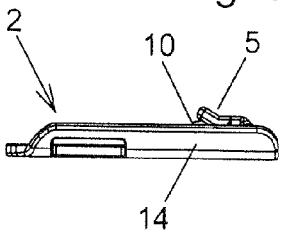
Figure 29:
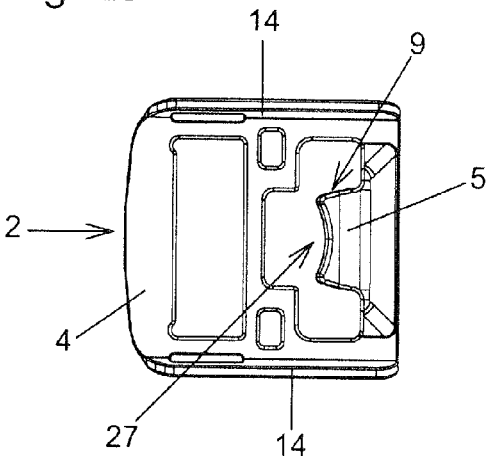
Figure 31:
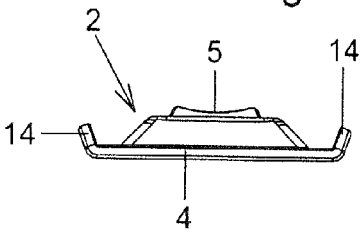
Figure 33:
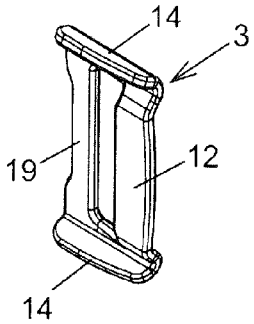

In order to be able to locate easily the tongue section 7 of the leaf spring 6 in order to unhook the eye part 3 from the hook 5 without having to look at it, preferred embodiments of the invention provide that the hook 5 and/or the leaf spring 6 has or have at least one element 27 which can be identified by touch. As a result, the leaf spring 6 and thus also its tongue section 7 can be located, without having to look at it, so that it can be actuated. They can thus be located almost blind. In the eighth exemplary embodiment, the element 27 which can be identified by touch is made in the form of an indentation in the hook 5. However, of course a bulge on the hook 5 or otherwise formed tactile elements, i.e. ones which can be located by touch, are also possible. Elements 27 which can correspondingly be identified by touch can of course also be arranged on the leaf spring 6. FIG. 27 shows a plan view in which the eye part 3 is hooked into the hook part 2. The tongue section 7 is situated in its blocking position. FIG. 28 shows a side view of this situation. The hook part base body 4 is shown in FIG. 29 with no eye part 3 and also with no leaf spring 6. The element 27, which can be identified by touch, in the form of an indentation in the hook 5 can be seen particularly well in the plan view according to FIG. 29. FIG. 30 shows a side view and FIG. 31 a front view of the hook part base body 4 according to FIG. 29.

Figure 32:
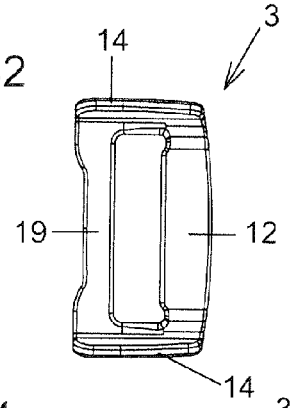
Figure 34:
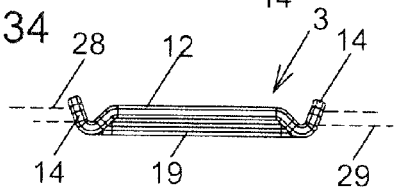
Figure 35:
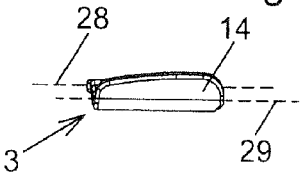

In FIGS. 32 to 35, the eye part 3 of this exemplary embodiment is shown detached from the other parts of the buckle 1. FIG. 32 in turn shows a plan view, FIG. 33 a perspective view, FIG. 34 a rear view and FIG. 35 a side view. As also in the first exemplary embodiment, this eye part 3 has a clip-in bar 19 for clipping into the hook 5, and a fastening means 12, here likewise designed as a bar, for fastening a belt or a strap or a rope on the eye part 3. In order to be able to construct the eye part 3 as compactly as possible and nevertheless clip it in and out of the hook 5, preferred alternatives provide that the clip-in bar 19 and the fastening means 12 are arranged in planes 28, 29 which are different from each other. These planes 28, 29 which are different from each other can be arranged parallel to each other but also so that they intersect. This is also the arrangement in the eighth exemplary embodiment. This can be seen particularly well in FIGS. 34 and 35, in which the planes 28 and 29 are drawn in dashed lines. The fastening means 12 is situated in the plane 28. The clip-in bar 19 lies in the plane 29. In this exemplary embodiment, the fastening means 12 is thus designed as an offset, as a result of which the possibility is prevented of the belt passed around the fastening means 12, a corresponding strap, or a rope passed around in a corresponding fashion, blocking the clipping-in and clipping-out movement.

KEY TO REFERENCE NUMERALS

1 buckle
2 hook part
3 eye part
4 hook part base body
5 hook
6 leaf spring
7 tongue section
8 fastening section
9 receiving opening
10 guide surface
11 eye part section
12 fastening means
13 groove
14 guide wall
15 pre-tensioning spring
16 direction of pressing
17 direction of pushing
18 direction of pulling
19 clip-in bar
20 direction of pivoting
21 leaf spring bearing
22 blocking tab
23 blocking spring
24 actuating element
25 fastening element socket
26 counter-bar
27 element that can be identified by touch
28 plane
29 plan

The invention claimed is:

1. A buckle, comprising at least one hook part and at least one eye part, the hook part has a hook part base body and a hook rigidly connected thereto and, in a connected state of the buckle, the eye part is hooked into the hook of the hook part and, in a separated state of the buckle, is unhooked from the hook of the hook part, and a securing device on the buckle for securing the connected state, the securing device including at least one leaf spring, a displaceably mounted bar as a fastening element for a belt or a rope or a strap, and the bar is pretensioned toward a clamping position by at least one pre-tensioning spring and the pre-tensioning spring is part of the leaf spring.

2. The buckle as claimed in claim 1, wherein the leaf spring has a freely projecting tongue section and a fastening section for fastening the leaf spring to the hook part.

3. The buckle as claimed in claim 2, wherein the leaf spring is fastened exclusively with the fastening section on the hook part.

4. The buckle as claimed in claim 2, wherein the freely projecting tongue section is in contact with the hook part exclusively via the fastening section.

5. The buckle as claimed in claim 1, wherein the leaf spring has a blocking position in which the leaf spring blocks a receiving opening of the hook for receiving the eye part, and the leaf spring has a release position in which the leaf spring releases the receiving opening of the hook for at least one of introducing or withdrawing the eye part at least one of into or out of the receiving opening.

6. The buckle as claimed in claim 5, wherein at least one of the leaf spring or the hook has at least one guide surface against which the eye part can be applied in the blocking position, and the leaf spring is pivotable into the release position by pulling the eye part bearing against the guide surface toward the receiving opening.

7. The buckle as claimed in claim 5, wherein the leaf spring is pivotable from the blocking position into the release position toward the hook part base body.

8. A buckle, comprising at least one hook part and at least one eye part, the hook part has a hook part base body and a hook rigidly connected thereto and, in a connected state of the buckle, the eye part is hooked into the hook of the hook part and, in a separated state of the buckle, is unhooked from the hook of the hook part, and a securing device on the buckle for securing the connected state, the securing device including at least one leaf spring, the hook part and the eye part each have mutually corresponding guide walls that act as a guide for centering the eye part and the hook part as they are hooked into and unhooked from one another.

9. The buckle as claimed in claim 8, wherein the guide walls are each designed such that they extend obliquely with respect to other areas of the hook part and the eye part.

10. The buckle as claimed in claim 1, wherein the eye part has an eye part section which, in order to hook the eye part into the hook, is pushable into a cross-sectionally U-shaped groove of the hook part when the leaf spring is deflected.

11. The buckle as claimed in claim 10, wherein the leaf spring is arranged on the hook part in the cross-sectionally U-shaped groove or opposite the hook, at a distance therefrom.

12. The buckle as claimed in claim 1, wherein at least one of the hook part base body or the eye part has a fastening element for fastening a belt or a rope or a strap.

13. The buckle as claimed in claim 1, wherein at least one of the hook or the leaf spring has or have at least one element which can be identified by touch.

14. The buckle as claimed in claim 1, wherein the eye part has a clip-in bar for clipping the eye part into the hook, and a fastening element for fastening a belt or a strap or a rope on the eye part, and the clip-in bar and the fastening element are arranged in planes which are different from each other and are parallel to each other or intersect.

15. The buckle as claimed in claim 2, wherein the fastening section is fastened to the hook part base body.

16. A buckle, comprising at least one hook part and at least one eye part, the hook part has a hook part base body and a hook rigidly connected thereto and, in a connected state of the buckle, the eye part is hooked into the hook of the hook part and, in a separated state of the buckle, is unhooked from the hook of the hook part, and a securing device on the buckle for securing the connected state, the securing device including at least one leaf spring, the leaf spring has a freely projecting tongue section and a fastening section for fastening the leaf spring to the hook part, and the freely projecting tongue section is in contact with the hook part exclusively via the hook.

17. A buckle, comprising at least one hook part and at least one eye part, the hook part has a hook part base body and a hook rigidly connected thereto and, in a connected state of the buckle, the eye part is hooked into the hook of the hook part and, in a separated state of the buckle, is unhooked from the hook of the hook part, and a securing device on the buckle for securing the connected state, the securing device including at least one leaf spring, the eye part has an eye part section which, in order to hook the eye part into the hook, is pushable into a cross-sectionally U-shaped groove of the hook part when the leaf spring is deflected, and the eye part section is in the form of a protruding projection which, in order to hook the eye part into the hook, is pushable into the cross-sectionally U-shaped groove of the hook part when the freely projecting tongue section of the leaf spring is deflected.

18. The buckle as claimed in claim 1, wherein at least one of the hook part base body or the hook or the eye part are designed as inherently rigid bodies.

19. The buckle as claimed in claim 1, wherein the at least one element which can be identified by touch is an indentation or a bulge in the hook.

* * * * *